US009802675B1

(12) United States Patent
Stillman

(10) Patent No.: US 9,802,675 B1
(45) Date of Patent: Oct. 31, 2017

(54) EXHAUST TRIM TAB FOR A BOAT

(71) Applicant: Fineline Industries, LLC, Merced, CA (US)

(72) Inventor: Shane Stillman, La Grand, CA (US)

(73) Assignee: Fineline LLC, Merced, CA (US)

( * ) Notice: Subject to any disclaimer, the term of this patent is extended or adjusted under 35 U.S.C. 154(b) by 0 days.

(21) Appl. No.: 15/206,903

(22) Filed: Jul. 11, 2016

(51) Int. Cl.
*B63B 1/22* (2006.01)
*B63B 35/85* (2006.01)

(52) U.S. Cl.
CPC ..... *B63B 1/22* (2013.01); *B63B 35/85* (2013.01)

(58) Field of Classification Search
CPC ..... B63B 1/22; B63B 35/85
See application file for complete search history.

(56) References Cited

U.S. PATENT DOCUMENTS

D155,018 S 8/1949 Lushbaugh
D189,008 S 10/1960 Foster
3,313,262 A * 4/1967 Yunker ..... B63B 39/061 114/287
D271,789 S 12/1983 Hardee
D306,396 S 3/1990 Brushaber
5,638,765 A 6/1997 Poulos
6,089,177 A * 7/2000 Muller ..... B63B 39/061 114/285
8,979,604 B1 3/2015 Woolley

* cited by examiner

*Primary Examiner* — Stephen P Avila
(74) *Attorney, Agent, or Firm* — Etherton Law Group, LLC

(57) ABSTRACT

A moveable exhaust trim tab for a motorized boat directs exhaust gas and cooling liquid into the water, changing the size and shape of the wake and reducing engine noise. The device comprises a trim tab base having a lip and a cap attached to the trim tab base to form a cavity between the lip and the cap into which the boat's exhaust is directed. The cavity has various apertures that permit the exhaust to exit the cavity and, in some embodiments, permit water to enter the cavity from below. The device may comprise baffles, outlets, inlets, and directional collars to change the flow of the exhaust. The trim tab is attached to the boat with an actuator that lets the trim tab to be adjusted at an angle relative to the boat.

14 Claims, 7 Drawing Sheets

EXHAUST TRIM TAB FOR A BOAT

FIELD OF INVENTION

The present invention relates generally to structures for changing the size and shape of a wake behind a boat. More particularly it relates to a structure that directs the boat's exhaust in such a way to change the size and shape of the wake.

BACKGROUND

Wakesurfing, wakeskating, and wakeboarding involve a rider being towed by a boat or personal watercraft. Once the boat takes off, the rider uses a tow rope to pull him- or herself upright out of the water. For wakesurfing, once the rider gains his balance he releases the rope and surfs the wake. For wakeboarding and wakeskating, the rider continues to hold on to the rope and performs acrobatics while the boat tows him. The size and shape of the wake affect the rider's experience. The size and shape of the wake is in turn affected by the boat shape, size, weight, direction, and speed. It is desirable, therefore, to improve the size and shape of a wake behind a water sport towboat.

Trim tabs are used on boats to compensate for the flow forces that act upon the hull during high-speed travel. By angular adjustment of a trim tab mounted at the stern, the tendency of water drag to impede forward motion can be changed and the handling of the boat improved. More recently, trim tabs have been used to purposefully modify the wake of a boat. One way to do so is to use one or more trim tabs to lift or lower the stern of the boat. Lifting the stern minimizes the wake of a boat, resulting in a relatively smooth water surface, which is desirable for water skiing. Lowering the stern increases the size and changes the shape of the wake, which is desirable for wake riding.

Exhaust gas from motors on towboats is often discharged below the surface of the water to prevent it from asphyxiating those riding in the boat and riding behind it. The location of the motor's exhaust gas outlet is designed to avoid increasing back pressure on the motor, which causes a decrease in motor performance—or kills the motor all together—and to avoid water backing up into the motor through the exhaust piping. Water-cooled inboard engines inject cooling water into the exhaust pipe, which cools the exhaust and muffles engine noise. The exhaust then pushes the water out the exhaust pipe. Forcing exhaust gas and water out below the surface of the water further reduces engine noise.

SUMMARY OF THE INVENTION

A moveable exhaust trim tab is used on a motorized boat to direct exhaust gas and cooling liquid into the water, changing the size and shape of the wake and reducing engine noise. The device comprises a trim tab base with a lip and a cap attached to the lip, which form a cavity into which the boat's exhaust is directed. Various apertures permit the exhaust to exit the cavity and, in some embodiments, permit water to enter the cavity from below. The device may comprise baffles, outlets, inlets, and directional collars to change the flow of the exiting exhaust. The trim tab is attached to the boat with an actuator that lets the trim tab to be adjusted at an angle relative to the boat.

DETAILED DESCRIPTION OF THE INVENTION

The present invention, referred to generally as 10, is a moveable exhaust trim tab for a motorized boat which directs exhaust gas and cooling liquid into the water. The device is used to change the size and shape of the wake and reduce engine noise. The trim tab can be used on any motorized watercraft, referred to herein as "boats," including inboard and outboard boats and personal watercraft used for towing.

Figure 5:
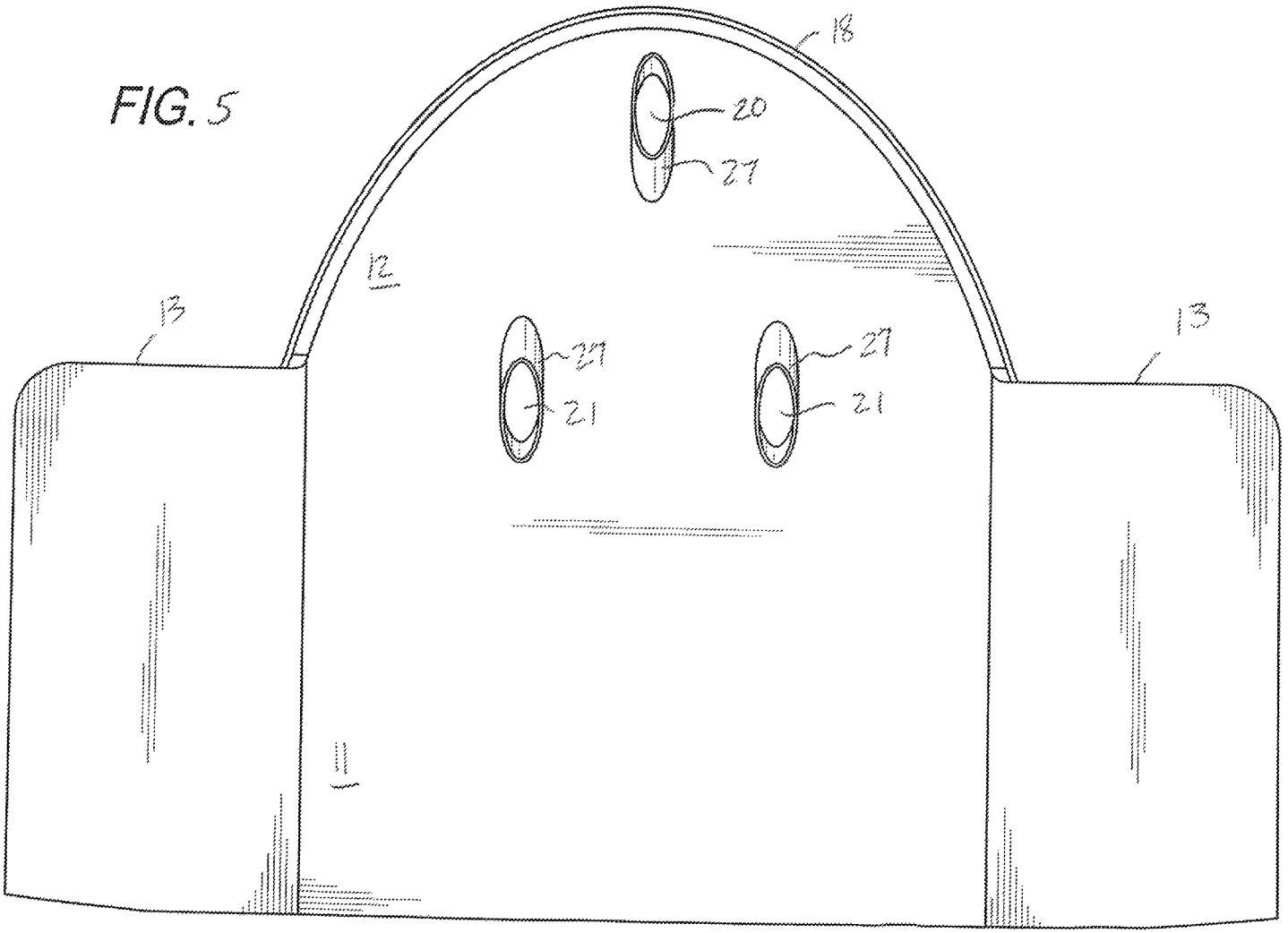
FIG. 5 is a bottom view of an exhaust trim tab for a boat.
Figure 6:
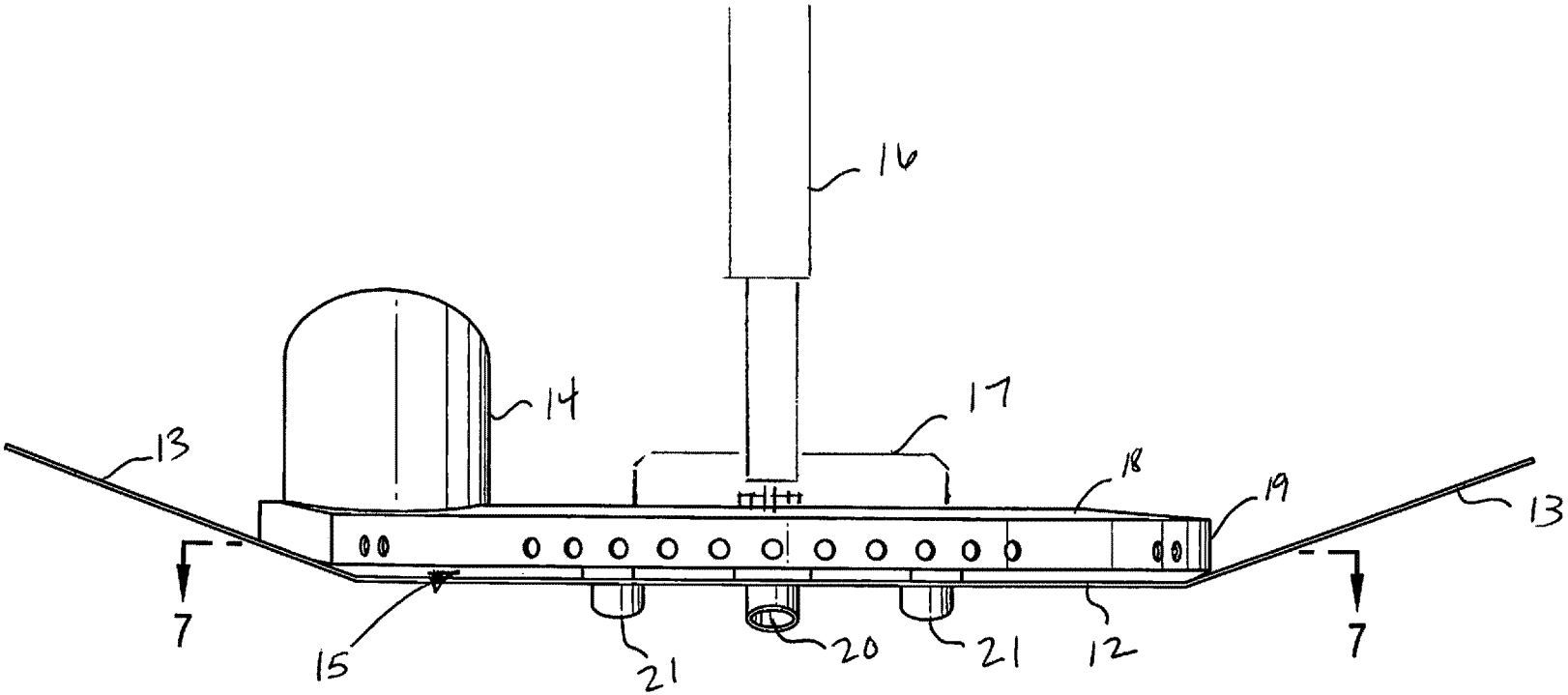
FIG. 6 is a front view of an exhaust trim tab for a boat.
Figure 7:
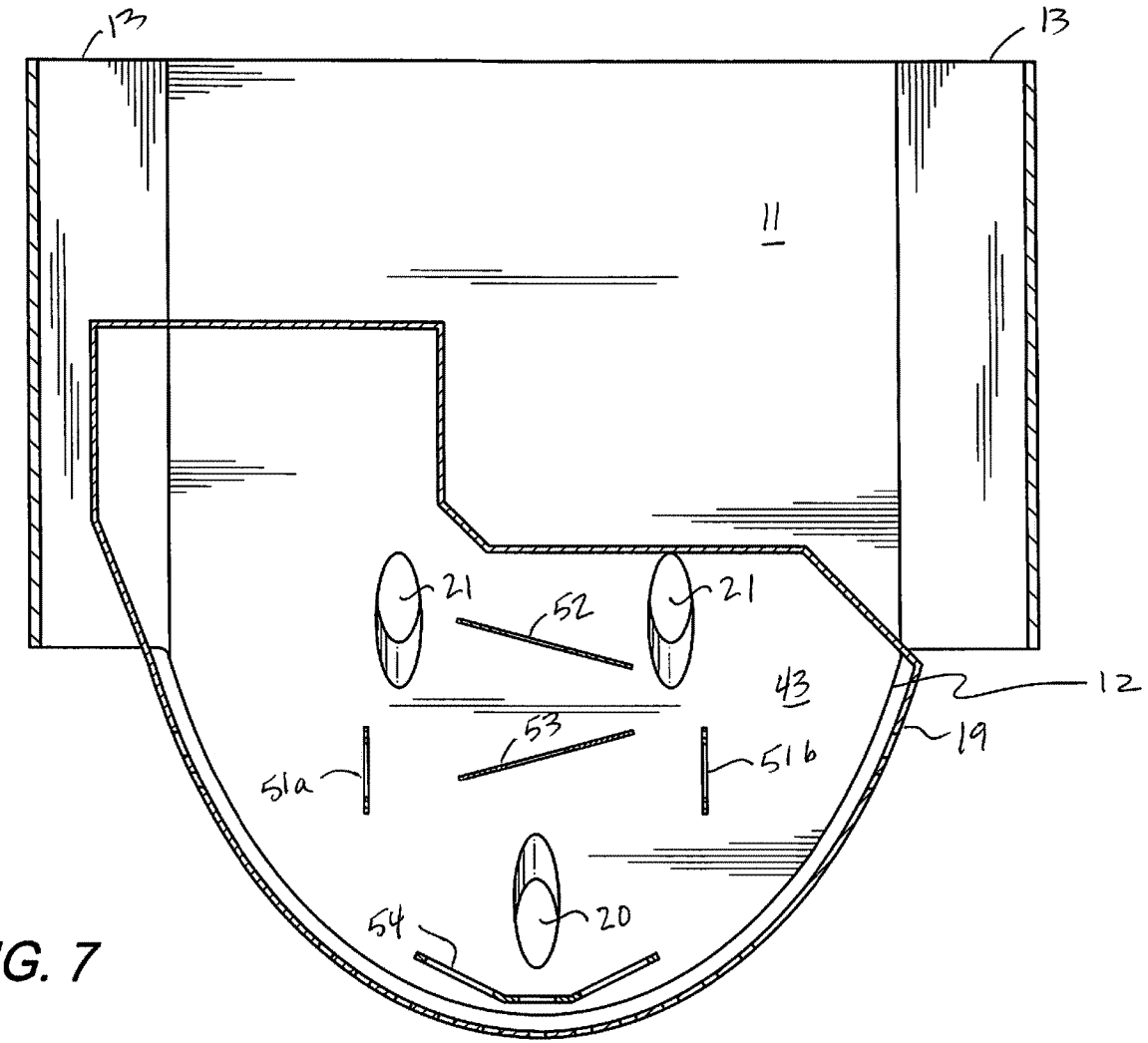
FIG. 7 is a cross-section view of an exhaust trim tab for a boat taken along line 7-7 in FIG. 6.

The present device 10 comprises a trim tab base 11 with at least one upturned edge 13 and a lip 12. See FIGS. 1-7. The lip 12 is an extension of the base 11 that is not an upturned edge 13. FIG. 5 most clearly shows the lip 12 as an extension of the base 11. Preferably the lip 12 is in the same plane as the base 11, but it too may be upturned to a degree the same or different from the upturned edges 13. The lip may instead be downturned. The lip 12 may take on any shape including an oval, a rectangle, square, trapezoid, polygon or other shape. For example, in the figures the lip 12 is generally semicircular.

A cap 18 is attached to the trim tab base 11 to form a cavity 43 between the cap 18 and the lip 12. Preferably the cap is about the same size and shape as the lip. Alternatively the cap 18 may be smaller or larger than the lip 12. For example a larger cap 18 may encompass the lip 12 and a portion of the trim tab base 11 in addition to the lip 12. The cap 18 may have an edge 19 extending at an angle toward the lip 12, partially or completely enclosing the cavity. In a preferred embodiment the edge of the cap 18 is spaced above the lip 12 to form a gap 15 between the lip 12 and the downturned edge 19 of the cap 18. In some embodiments the cap 18 is disposed at an angle relative to the lip 12 so that the width of the gap 15 increases distally from the point the cap attaches to the trim tab base 11.

The exhaust from the boat's motor is directed to the cavity 43 through the exhaust pipe connector 14. As referred to herein, the boat's exhaust is gas or liquid, and typically a combination of both. Typically the connector 14 is connected to the boat's exhaust outlet via a rigid or flexible tube or pipe 23.

Figure 1:
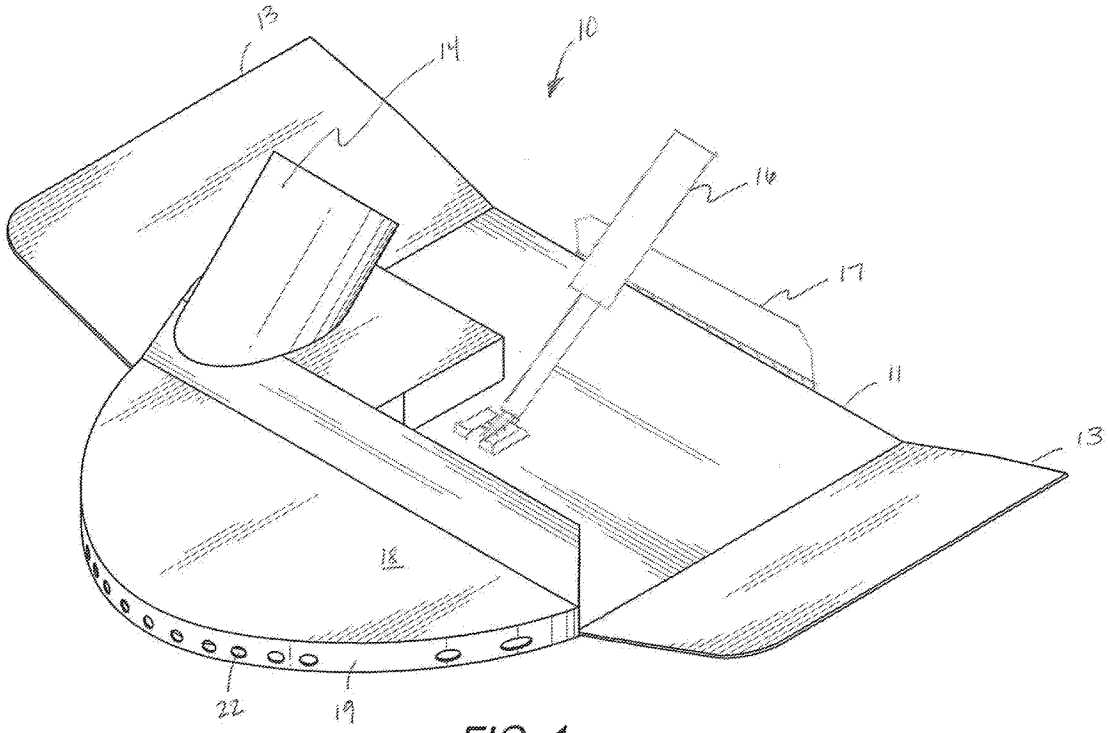
FIG. 1 is a top perspective view of the present exhaust trim tab for a boat.
Figure 2:
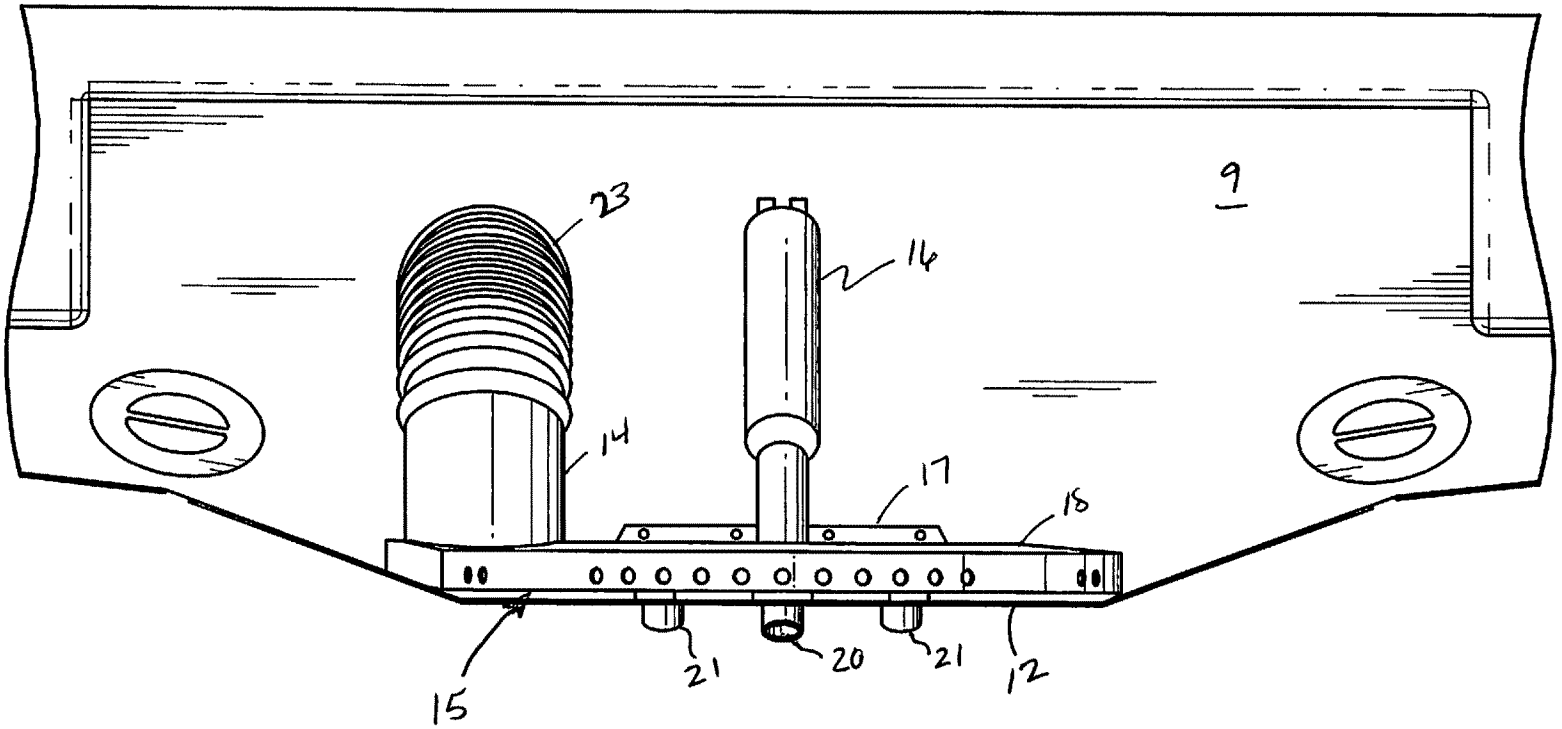
FIG. 2 is a front view of an exhaust trim tab on a boat.
Figure 3:
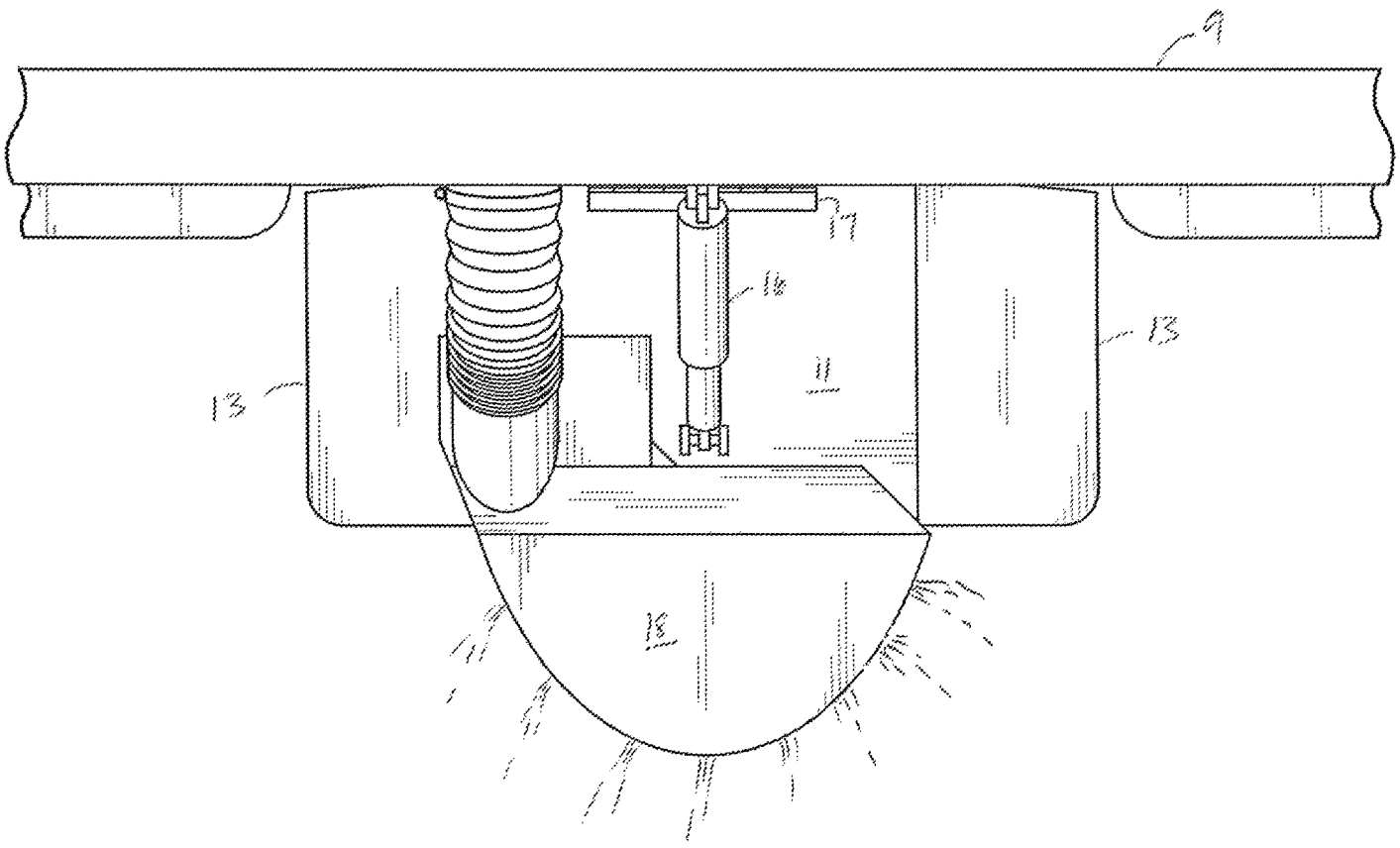
FIG. 3 is a top view of an exhaust trim tab on a boat.
Figure 4:
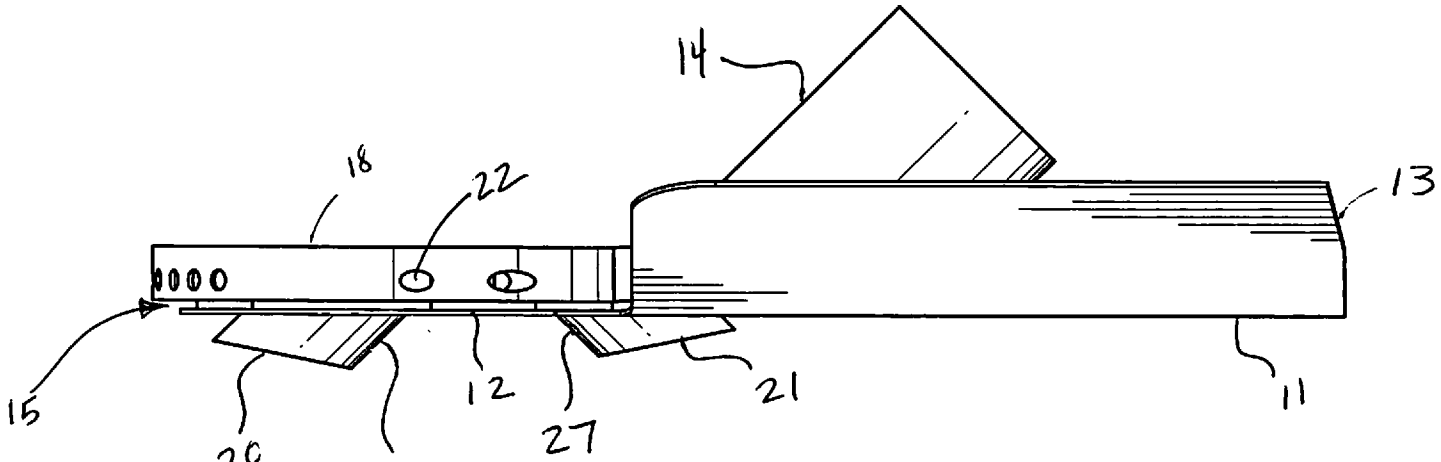
FIG. 4 is a side view of an exhaust trim tab for a boat.

The device may comprise baffles, outlets, inlets, and directional collars to change the flow of the exhaust. Various apertures permit the exhaust to exit the cavity 43 and, in some embodiments, permit water to enter the cavity from below. For example, one or more apertures 22 may be placed in the cap edge 19 to permit exhaust to exit the cavity 43. The apertures 22 in the cap edge 19 are preferably circular holes, but may take on any shape such as rectangles, oblong slits or slots, square or diamonds, or other shape. FIG. 3 depicts exhaust flowing out apertures 22. The exhaust may also exit the cavity through the aperture created by gap 15. One or more apertures in the trim tab base 11 permit the exhaust to exit out the bottom of the cavity. The apertures 20 and 21 in the trim tab base 11 are also preferably circular holes, but may take on any shapes such as rectangles, oblong slits or slots, square or diamonds, or other shape. Preferably each aperture in the trim tab base 11 has a collar 27 to direct the flow of the exhaust after it exits the aperture. See FIGS. 2 and 4-7. A collar 27 angled rearward directs exhaust rearward toward the wake; such an aperture is an exhaust outlet 20. A collar 27 angled forward toward the bow of the boat causes the aperture to permit water into the cavity as the boat moves forward. Such inlet apertures 21 allow water into the cavity, causing turbulence and forcing more water out the apertures.

Baffles inside the cavity 43 direct the incoming and exiting water. See FIG. 7. Any number of baffles may be used, selected and positioned to obtain the desired outflow and acceptable backpressure on the motor. In a preferred embodiment there are five baffles. Baffles 51*a* and 51*b* are disposed between the outlet 20 and inlets 21, about parallel to the longitudinal axis of the boat. Baffle 52 is disposed between inlets 21 at an angle in which the port side of baffle 52 is forward of the starboard side of baffle 52. Baffle 53 is disposed between baffles 51*a* and 51*b* at an angle in which the starboard side of baffle 52 is forward of the port side of baffle 52. Baffle 54 is disposed aft of outlet 20 and centered on outlet 20. Preferably the baffles are connected along their entire lengths to the lip 12 and cap 18 to prevent exhaust from flowing over or under the baffles.

The exhaust trim tab 10 is connected to the boat in a location that enables it to modify the wake of a boat. A hinge 17 connects the device 10 to the boat and cooperates with an actuator 16 to let the trim tab 10 be adjusted at an angle relative to the boat. The distal end of the actuator 16 is pivotably attached to device 10, and preferably to the trim tab base 11. The proximal end of the actuator 16 is pivotably attached to the boat. Any pivoting fastener may be used to attach the actuator to the device 10 and boat, but preferably the fastener is a u-shaped bracket and pin. The actuator may be hydraulic, electrical or mechanical and may be operated manually but preferably electronically. In preferred embodiments the device 10 is attached to the transom 9 of the boat. See FIGS. 2 and 3.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. An exhaust trim tab for a boat having a motor, the exhaust trim tab comprising:

a. a trim tab base having a lip;

b. a cap attached to the trim tab base to form a cavity between the cap and the lip;

c. an exhaust pipe connector for transmitting exhaust from the motor to the cavity; and d. one or more exhaust apertures in the trim tab base.

2. The exhaust trim tab of claim 1 wherein the trim tab base has one or more upturned edges.

3. The exhaust trim tab of claim 1 wherein the cap is attached to the trim tab base at a spaced interval to form a gap between the cap and the trim tab base.

4. The exhaust trim tab of claim 1 further comprising one or more exhaust apertures in the cap.

5. The exhaust trim tab of claim 1 further comprising:

a. an actuator attached to the trim tab base; and b. a hinge connected to the trim tab base, wherein the actuator and the hinge cooperate to enable the trim tab base to be adjusted angularly relative to the boat.

6. The exhaust trim tab of claim 1 wherein at least one of the exhaust apertures in the trim tab base has a collar angled toward the rear of the boat.

7. The exhaust trim tab of claim 1 wherein at least one of the exhaust apertures in the trim tab base has a collar angled away from the rear of the boat.

8. The exhaust trim tab of claim 1 wherein at least one of the exhaust apertures in the trim tab base has a collar angled toward the bow of the boat.

9. The exhaust trim tab of claim 1 further comprising one or more baffles in the cavity.

10. An exhaust trim tab system for a boat having a motor, the system comprising:

a. a trim tab base having a lip and two upturned edges at opposite ends of the trim tab base;

b. a cap attached to the trim tab base above the lip to form a cavity, wherein:

i. the cap has a top surface;

ii. the cap has a cap edge extending at about a right angle from the cap's top surface toward the trim tab base; and iii. the cap is disposed above the trim tab base to form a gap between the cap edge and the trim tab base;

c. a plurality of edge apertures in the cap edge;

d. an exhaust pipe connector in fluid communication with the cavity; and e. one or more trim tab base apertures in the trim tab base wherein at least one trim tab aperture is angled toward the rear of the boat.

11. The exhaust trim tab system of claim 10 wherein the boat has a transom, the exhaust trim tab further comprising:

a. an actuator with its distal end pivotably attached to the trim tab base and its proximal end pivotably connected to the transom; and b. a hinge connecting the trim tab base and the transom, wherein the actuator and the hinge cooperate to enable the trim tab base to be adjusted angularly relative to the boat.

12. The exhaust trim tab system of claim 10 further comprising one or more baffles in the cavity.

13. An exhaust trim tab system for a boat having a motor, the system comprising:

a. a trim tab base having a lip and two upturned edges at opposite ends of the trim tab base;

b. a cap having the same size and shape as the lip attached to the trim tab base above the lip to form a cavity, wherein:

i. the cap has a cap edge extending downward toward the trim tab base; and ii. the cap is disposed above the trim tab base to form a gap between the cap edge and the trim tab base;

c. a plurality of edge apertures in the cap edge;

d. an exhaust pipe connector for transmitting exhaust from the motor to the cavity;

e. three trim tab base apertures in the trim tab base wherein:

i. a first trim tab base aperture has a collar angled toward the rear of the boat; and ii. a second trim tab base aperture and a third trim tab base aperture each has a collar angled toward the bow of the boat;

f. an actuator attached to the trim tab base; and g. a hinge connected to the trim tab base, wherein the actuator and the hinge cooperate to enable the trim tab base to be adjusted angularly relative to the boat.

14. The exhaust trim tab system of claim 13 further comprising one or more baffles in the cavity.

* * * * *